US012722193B2

(12) United States Patent
Fabro

(10) Patent No.: US 12,722,193 B2
(45) Date of Patent: Sep. 1, 2026

(54) DRAWING AND STRAIGHTENING UNIT FOR METAL PRODUCTS, AND CORRESPONDING METHOD

(71) Applicant: M.E.P. MACCHINE ELETTRONICHE PIEGATRICI S.P.A., Reana del Rojale (IT)

(72) Inventor: Giorgio del Fabro, Udine (IT)

(73) Assignee: M.E.P. MACCHINE ELETTRONICHE PIEGATRICI S.P.A. (IT)

( * ) Notice: Subject to any disclaimer, the term of this patent is extended or adjusted under 35 U.S.C. 154(b) by 269 days.

(21) Appl. No.: 18/038,350

(22) PCT Filed: Nov. 24, 2021

(86) PCT No.: PCT/IT2021/050378

§ 371 (c)(1),
(2) Date: May 23, 2023

(87) PCT Pub. No.: WO2022/113138

PCT Pub. Date: Jun. 2, 2022

(65) Prior Publication Data

US 2024/0091837 A1 Mar. 21, 2024

(30) Foreign Application Priority Data

Nov. 24, 2020 (IT) ..... 102020000028259

(51) Int. Cl.
*B21D 1/02* (2006.01)

(52) U.S. Cl.
CPC ..... *B21D 1/02* (2013.01)

(58) Field of Classification Search
CPC ..... B21D 1/02; B21D 1/06; B21D 43/006; B21F 23/00; B21F 23/005; B21F 23/002
See application file for complete search history.

(56) References Cited

U.S. PATENT DOCUMENTS

| | | | | |
|---|---|---|---|---|
| 9,452,466 | B2 * | 9/2016 | Del Fabro | B21D 43/006 |
| 2003/0074944 | A1 * | 4/2003 | Stjepan | B21F 23/002 72/140 |
| 2019/0337037 | A1 | 11/2019 | Pezzuto | |

FOREIGN PATENT DOCUMENTS

| | | |
|---|---|---|
| EP | 0 930 112 | 9/2003 |
| EP | 2 794 146 | 4/2016 |

OTHER PUBLICATIONS

International Search Report and Written Opinion corresponding to International Patent Application No. PCT/IT2021/050378, mailed Mar. 24, 2022.

* cited by examiner

*Primary Examiner* — Teresa M Ekiert
(74) *Attorney, Agent, or Firm* — McAndrews, Held & Malloy, Ltd.

(57) ABSTRACT

Drawing and straightening unit (10) having at least one first roller (12) and at least one second roller (16, 17, 18) opposite said first roller (12) with respect to an axis of feed (X) of said at least one metal product (P). The present invention also concerns an apparatus (100), comprising a feed unit (119) and a drawing and straightening unit (10), and a corresponding method to draw and straighten metal products (P) with said drawing and straightening unit (10).

11 Claims, 2 Drawing Sheets

DRAWING AND STRAIGHTENING UNIT FOR METAL PRODUCTS, AND CORRESPONDING METHOD

FIELD OF THE INVENTION

The present invention concerns a drawing and straightening unit used to feed a machine for working elongated metal products.

In particular, the drawing and straightening unit according to the present invention is applied, preferentially, but not restrictively, to machines that simultaneously work two bars, round pieces or wires, at a time, carrying out a uniform, coordinated and simultaneous feed.

BACKGROUND OF THE INVENTION

Bending/shaping machines, or stirrup-making machines, are known, which are fed with elongated metal products, such as metal wires from a roll or pre-cut bars, to make reinforcement products for the building trade.

Both metal products fed from a roll, and also those in pre-cut bars are generally obtained at the end of the hot rolling cycle and normally have a series of ribs on the outside, to improve the conditions of adhesion to the cement during use.

Furthermore, in the case of metal products stored in rolls, a straightening operation must be performed before they are used, in order to eliminate the loops, bends and internal tensions present in the product. Generally, the straightening operation takes place upstream of the drawing operation.

Typically, bending/shaping machines are fed with one or more metal products at a time in order to optimize the productivity of the machine.

The machines are fed through drawing and straightening units which normally comprise a motorized roller provided with one or more circular grooves, in which the metal products to be fed are disposed, and one or more contrast rollers, opposite the motorized roller with respect to the metal products.

Upstream of the drawing and straightening unit there is a feed unit that allows to supply the metal products substantially in line with the axis of feed.

The feed unit can comprise guide apertures with different shapes and/or diameters, through which the metal wire or wires unwound from respective coils pass.

One disadvantage of known drawing and straightening units is that, although the metal products to be drawn are supplied by the feeder substantially already aligned with the axis of feed, they may not be perfectly aligned with the grooves of the motorized roller.

Non-alignment or inaccurate alignment can cause high wear on part of the upper edges of the grooves or of the free surfaces of the motorized roller. The deformation of the grooves, or in any case a widening of the inlet zone, can cause an incorrect positioning of the metal products and an ineffective drawing.

Another disadvantage is that when the diameter of the wire or wires being worked is changed, there is a need to align the apertures in the feed unit with the grooves of the motorized drawing roller. In the state of the art, this entails the need to translate the entire feed unit laterally, involving complex movement and alignment operations.

There is therefore a need to perfect a drawing and straightening unit for elongated metal products which can overcome at least one of the disadvantages of the state of the art.

In particular, one purpose of the present invention is to provide such a drawing and straightening unit able to limit wear on the circular grooves of the motorized roller.

Another purpose of the present invention is to provide such a drawing and straightening unit which allows an extremely precise alignment of the metal products to be worked, limiting possible strains and stresses in unforeseen directions.

Another purpose is to perfect a drawing and straightening method which is simple to implement and rapidly allows a precise engagement of the drawing unit with the products being worked.

The Applicant has devised, tested and embodied the present invention to overcome the shortcomings of the state of the art and to obtain these and other purposes and advantages.

SUMMARY OF THE INVENTION

The present invention is set forth and characterized in the independent claims. The dependent claims describe other characteristics of the present invention or variants to the main inventive idea.

In accordance with the above purposes, a drawing and straightening unit for feeding one or more elongated metal products to a working machine comprises at least one first roller provided peripherally with a plurality of circular grooves inside each of which at least one metal product to be fed is able to be positioned, and at least one second roller opposite the first roller with respect to an axis of feed of the at least one metal product.

According to one aspect of the present invention, there are adjustment means associated with the drawing and straightening unit which are able to move the drawing and straightening unit in a direction of adjustment transverse with respect to the axis of feed, so as to align one or more of the grooves with respective metal products fed by a feed unit disposed upstream of the drawing and straightening unit.

The invention also concerns an apparatus for feeding elongated metal products comprising a feed unit, a drawing and straightening unit having at least one first roller provided peripherally with a plurality of circular grooves. Normally, the working apparatus also comprises a machine for working the metal products as above.

According to one aspect, there are adjustment means associated with the drawing and straightening unit to move it in a direction of adjustment transverse with respect to an axis of feed of at least one metal product, so as to align one or more of the grooves with one or more metal products fed by the feed unit.

The invention also concern a drawing and straightening method for feeding one or more elongated metal products. The method comprises:

- a step of supplying one or more metal products to a drawing and straightening unit carried out by a feed unit;
- a step of drawing the one or more metal products by means of the drawing and straightening unit, in which the at least one first roller accommodates, in respective circular grooves, the one or more metal products which are simultaneously contrasted in position by the at least one second roller with respect to the axis of feed.

According to one aspect, between the supply step and the drawing step there is provided an adjustment step in which the drawing unit is moved in a direction of adjustment transverse with respect to the axis of feed, so as to align one or more of the grooves with respective metal products supplied by the feed unit.

BRIEF DESCRIPTION OF THE DRAWINGS

These and other aspects, characteristics and advantages of the present invention will become apparent from the following description of some embodiments, given as a non-restrictive example with reference to the attached drawings wherein.

Figure 1:
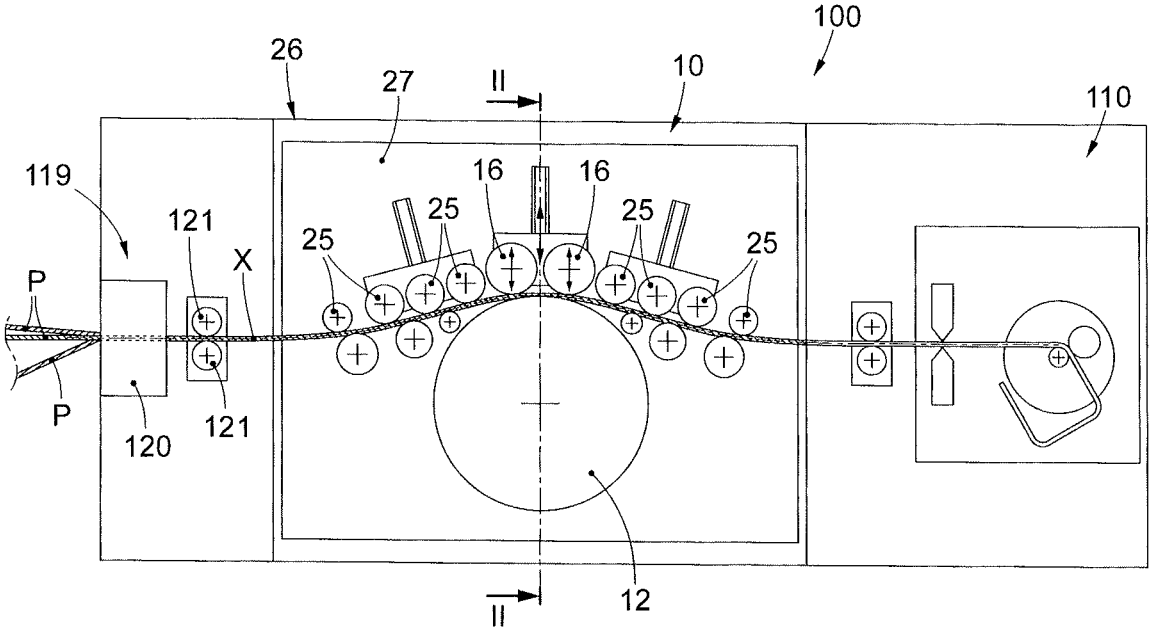
FIG. 1 is a front view of an apparatus for working elongated metal products in which there is a drawing and straightening unit in accordance with the embodiments described here.

To facilitate comprehension, the same reference numbers have been used, where possible, to identify identical common elements in the drawings. It is understood that elements and characteristics of one embodiment can be conveniently combined or incorporated into other embodiments without further clarifications.

DETAILED DESCRIPTION OF SOME EMBODIMENTS

We will now refer in detail to the possible embodiments of the invention, of which one or more examples are shown in the attached drawings, by way of a non-limiting illustration. The phraseology and terminology used here is also for the purposes of providing non-limiting examples.

The embodiments described with reference to the attached drawings concern a drawing and straightening unit 10 which is part of an apparatus for working metal products 100.

The drawing and straightening unit 10 is suitable, for example, to feed a working machine 110, which can be a bending/shaping machine or a stirrup-making machine, which is fed with at least one elongated metal product P, for example a metal wire or round piece, advantageously two simultaneously.

The metal products P in question are typically contained in rolls or coils, disposed upstream of the apparatus for working bars 100.

The metal products P can be characterized by very different diameters, materials and surface finishes, for example ribs.

This variability of the metal products P is given by the need of the working machine 110 to produce a more or less complex range of finished products, for example brackets, suitable for a variety of applications.

According to some embodiments, the drawing and straightening unit 10 has at least one first roller 12 provided peripherally with a plurality of circular grooves 13, 14, 15 inside each of which a respective metal product P to be fed is able to be positioned.

The drawing and straightening unit 10 comprises at least one second roller 16, 17, 18 opposite the first roller 12 with respect to an axis of feed X of the at least one metal product P.

According to some embodiments, the at least one first roller 12 is motorized and the at least one second roller 16, 17, 18 is idle and is adjustable at least vertically with respect to the first roller 12.

Advantageously, the number of second rollers 16, 17, 18 is equal to the number of grooves 13, 14, 15 of the first roller 12, so that each second roller 16, 17, 18 is aligned with a respective groove 13, 14, 15.

With particular reference to the example described here, the first roller 12 is provided with three grooves, in particular an internal groove 15, an external groove 13 and a central groove 14 made between them.

The grooves 13, 14, 15 are circular and have a substantially V-shaped cross section with sizes correlated to the nominal diameter of the metal products P to be fed.

The second rollers comprise a second external roller 18, a second internal roller 16 and a second central roller 17 disposed between them.

Advantageously, the second rollers 16, 17, 18 are configured to rotate independently of each other, in a way that is per se known.

Figure 2:
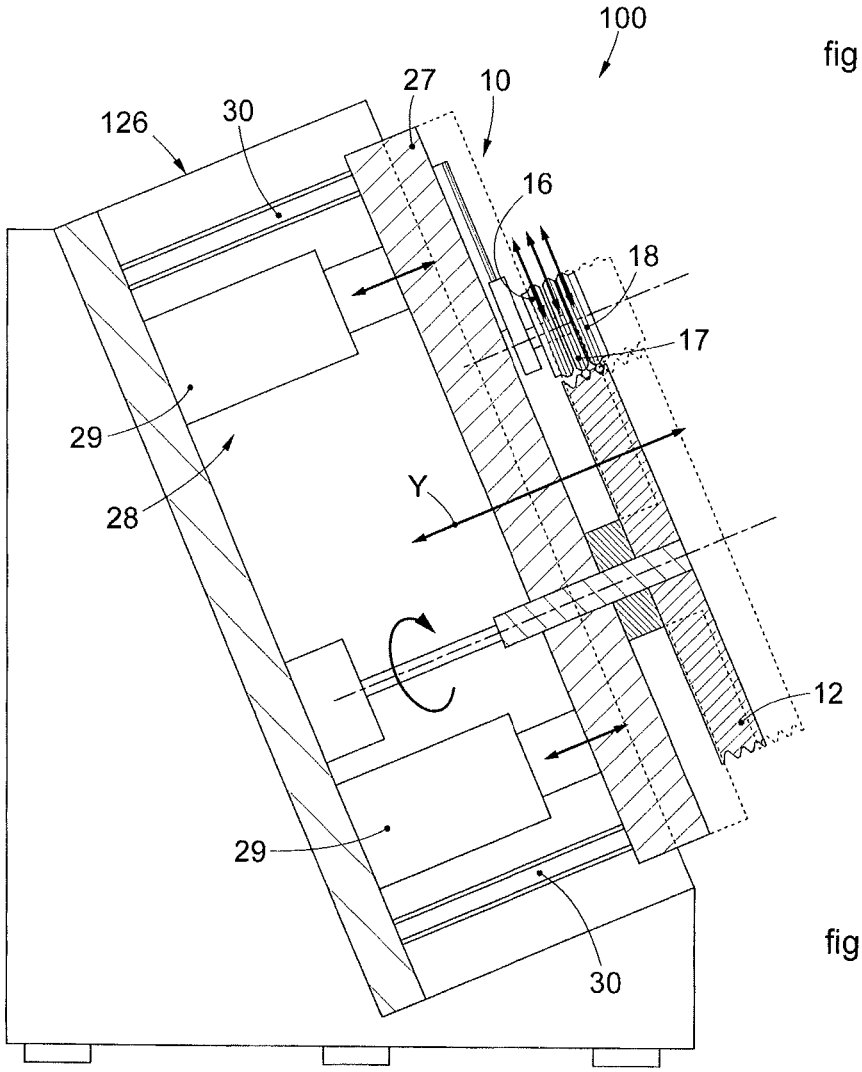
FIG. 2 is a section view along line II-II of FIG. 1.

Furthermore, with reference to FIG. 2, each second roller 16, 17, 18 can advantageously be moved independently toward/away from the first roller 12 in order to keep each metal product P correctly positioned inside the respective groove 13, 14, 15.

There can also be provided an overall movement of the second rollers 16, 17, 18 with a greater excursion than the excursion of the independent movements, for example to perform an initial approach toward the first roller 12.

Furthermore, the drawing and straightening unit 10 can comprise more than one group of second rollers 16, 17, 18.

With reference to FIG. 1, the drawing and straightening unit 10 comprises two groups of second rollers 16, 17, 18 disposed one after the other along the axis of feed X.

Figure 3:
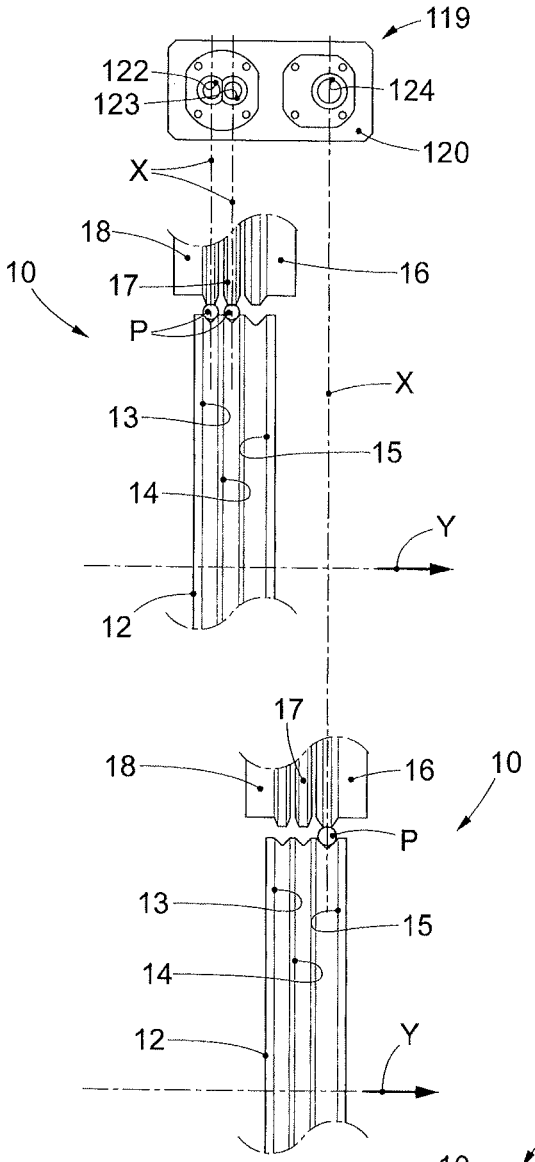
FIG. 3 schematically shows a possible sequence of movement of the drawing and straightening unit with respect to the feed unit.

The at least one second roller 16, 17, 18 can have a smooth peripheral surface, or one provided with circumferential grooves or ridges, as shown in the example of FIGS. 2-3, to carry out a more effective flattening of the metal products P.

Upstream of the drawing and straightening unit 10 there is a feed unit 119 comprising at least one feeder unit 120 configured to slidingly support a portion in length of a certain number of metal products P to be supplied to the drawing and straightening unit 10.

The number of metal products P supported by the feed unit 119 substantially depends on the range of finished products that the working machine 110 fed by the drawing and straightening unit 10 has to produce.

According to one aspect of the present invention, the drawing and straightening unit 10 is mobile in a direction of adjustment Y transverse with respect to the axis of feed X in order to transversely align one or more of the grooves 13, 14, 15 with respective metal products P fed by the feed unit 119.

This solution therefore allows to obtain a precise and defined alignment of the drawing and straightening unit 10 with the metal products P at entry, preventing unwanted and ineffective draws, transverse stresses, and excessive wear of the grooves 13, 14, 15, particularly along the edge, or points, of attachment, that is, the points at which the metal products P enter the grooves 13, 14, 15.

According to some embodiments, the apparatus 100 comprises a support structure 126 with which there are associated at least the drawing and straightening unit 10 and favorably also the feed unit 119 and the working machine 110.

The support structure 126 can be favorably configured to support the drawing and straightening unit 10 and the feed unit 119 in an inclined position with respect to the plane, for example the floor, where the support structure 126 is disposed resting, see for example FIG. 2.

For example, the drawing and straightening unit 10 and the feed unit 119 can be disposed on a common lying plane, or on parallel lying planes, equally inclined with respect to the floor plane.

The feeder body 120 is provided with guide apertures 122, 123, 124 through which respective metal products P to be supplied to the drawing and straightening unit 10 are supported slidingly.

The feed unit 119, in particular the feeder body 120, can be disposed in such a way that at least the through axis of one of the guide apertures 122, 123, 124 that supports the metal product P to be fed is coplanar and parallel with an initial segment of the axis of feed X.

The axis of feed X can coincide on each occasion with the through axis of one of the guide apertures 122, 123, 124.

In the case of two guide apertures, for example, 122, 123 coupled for the simultaneous advance of two metal products P, there can be defined two axes of feed X parallel to each other, distinct and aligned with the axes of the same guide apertures 122, 123.

The feed unit 119 can comprise a pair of engagement rollers 121 disposed between the feeder body 120 and the drawing and straightening unit 10 in order to engage and draw a first segment of metal product P, for example during a format change operation.

The guide apertures 122, 123, 124 of the feeder body 120 can have a substantially circular shape and a diameter coherent with a maximum transverse size of the metal product P to be fed.

The guide apertures 122, 123, 124 are made through the feeder body 120 and have respective through axes parallel to each other.

For example, the guide apertures 122, 123, 124 are made through from one side of the feeder body 120 facing the coil magazine, to an opposite side facing toward the drawing and straightening unit 10, as shown with a dashed line in FIG. 1.

The through axes of the guide apertures 122, 123, 124 can be coplanar or offset in some way.

With particular reference to FIG. 3, an example is described in which the guide apertures 122, 123 are coupled and have a substantially identical diameter, allowing the simultaneous support and sliding of two metal products P having the same geometric characteristics, while the guide aperture 124 is single and has a larger diameter than the diameter of the guide apertures 122, 123.

Other configurations and dispositions of the guide apertures 122, 123, 124 and of possible additional guide apertures are possible.

The drawing and straightening unit 10 can be moved in the direction of adjustment Y with an adjustment range coherent with the position of the apertures 122, 123, 124.

In particular, the drawing and straightening unit 10 is mobile between a waiting position and a plurality of alignment positions.

Each alignment position is reached by moving the drawing and straightening unit 10 in such a way as to transversely align the grooves 13, 14, 15 with one or more of the guide apertures 122, 123, 124 along the axis or axes of feed X.

The waiting position can be a generic position of the drawing and straightening unit 10 which is located between the maximum range position and the minimum range position. For example, the waiting position can be the last alignment position previously reached.

With reference to FIG. 3, a possible sequence of movement of the drawing and straightening unit 10 is shown by way of example, in which, for simplicity, only the first roller 12 and the second rollers 16, 17, 18, and the feeder body 120 have been shown.

In a first case, top left of FIG. 3, the drawing and straightening unit 10 can pass from a waiting position, for example central, to a first alignment position in which the grooves 13, 14 are aligned with the guide apertures 122, 123 along a pair of axes of feed X. In this case, the working machine 110 positioned downstream of the drawing and straightening unit 10 is adjusted to work two metal products P simultaneously.

In a second case, at the bottom right of FIG. 3, the drawing and straightening unit 10 can pass from the waiting position, for example coinciding with the previous alignment position, to a second alignment position where the groove 15 is aligned with the guide aperture 124 along the axis of feed X, in such a way that the working machine receives a single metal product P having a larger diameter.

Operationally, it is preferable to feed either a pair of identical metal products P with a smaller diameter, or a single metal product P with a larger diameter.

The direction of adjustment Y is substantially orthogonal to the axis of feed X which can be rectilinear, for example immediately at the exit from the feeder body 120, or possibly comprise a curved segment, for example in a zone comprised between the entry section and the exit section of the drawing and straightening unit 10.

In fact, in possible configurations, the drawing and straightening unit 10 can also comprise a plurality of yielding rollers 25 disposed upstream and downstream of the first roller 12 and of the at least one second roller 16, 17, 18, defining with them as a whole a drawing loop that delineates a curve in the axis of feed X.

The direction of adjustment Y is parallel to the axis of rotation of the first roller 12 and of the second roller 16, 17, 18.

The drawing and straightening unit 10 comprises an assembly defined by a mobile support 27 with which the first roller 12 and the at least one second roller 16, 17, 18 are associated, and the movement means 28 are able to move the assembly in an integral way in the direction of adjustment Y.

With reference to FIG. 2, the movement means 28 can be disposed between the support structure 126 and the mobile support 27.

The mobile support 27 can be configured as a substantially flat metal plate on the external side of which the first roller 12 and the at least one second roller 16, 17, 18 are attached, in a way per se known. However, other constructive configurations are not excluded.

The movement means 28 can comprise at least one of either a jack, a linear actuator, sliding guides, chain mechanisms, rack or grub screw mechanisms, or suchlike.

The movement means 28 can comprise position detection devices, for example position transducers capable of identifying the position of the drawing unit 10 in the direction of adjustment Y.

In the example shown in FIG. 2, the movement means 28 comprise a pair of hydraulic cylinders 29, associated with the support structure 126 on one side and with the mobile support 27 on the opposite side, able to move the mobile support 27 in a sliding way on a pair of guides 30.

Possible position detection devices can also be provided in association or in combination with the feed unit 119 so as to coordinate the position of the drawing and straightening unit 10, in particular of the grooves 13, 14, 15, with the position of the feed unit 119, in particular of the guide apertures 122, 123, 124.

Figure 4:
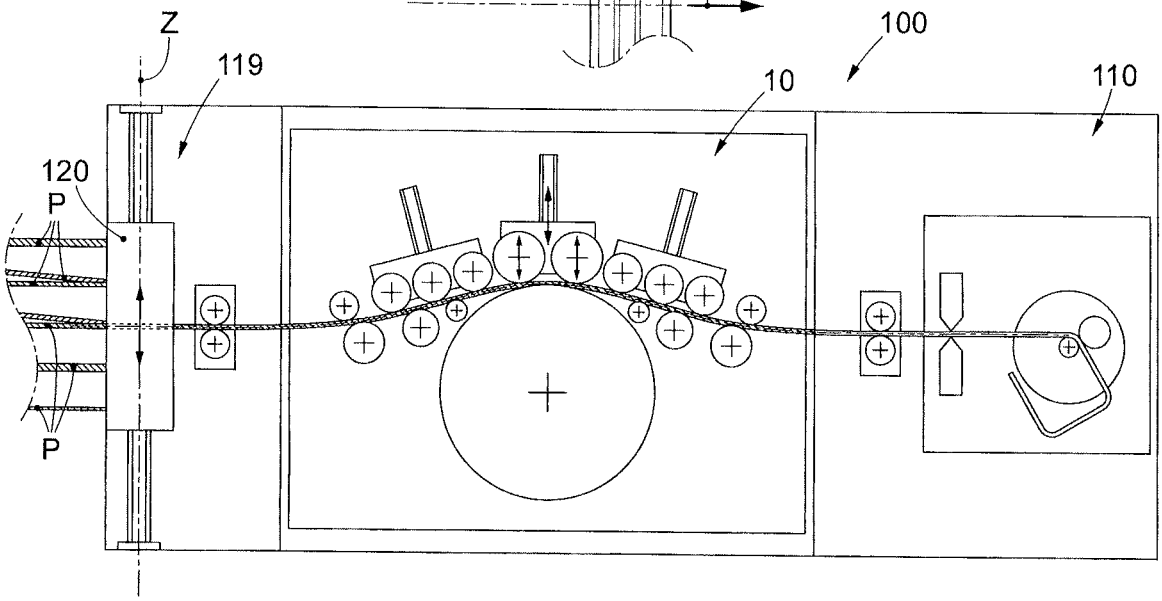
FIG. 4 is a variant of FIG. 1.

According to one possible variant, shown in FIG. 4, the feeder body 120 of the feed unit 119 can be mobile along an axis of alignment Z orthogonal to the axis of feed X and to the direction of adjustment Y.

The feeder body 120 can comprise a plurality of guide apertures disposed at different levels on the feeder body 120, the different levels being defined at different heights along the axis of alignment Z.

This variant can be particularly useful in the event that it is necessary to provide to feed a range of very different metal products P, without interrupting the work cycle or replacing the feeder body 120.

According to another variant, at least the feeder body 120 of the feed unit 119 can also be mobile in a direction of registration substantially parallel to the direction of adjustment Y.

According to some embodiments, a method for drawing and straightening metal products P is provided. The method provides:

- a step of supplying one or more metal products P to the drawing and straightening unit 10 carried out by the feed unit 119 which supports them slidingly,
- a step of drawing the one or more metal products P by means of the drawing and straightening unit 10 in which the at least one first roller 12 accommodates, in respective circular grooves 13, 14, 15, the one or more metal products P which are simultaneously contrasted in position by the at least one second roller 16, 17, 18 with respect to the axis of feed.

According to one aspect, between the supply step and the drawing step there is provided an adjustment step in which the drawing unit 10 is moved in the direction of adjustment Y transverse with respect to the axis of feed X so as to align one or more of the grooves 13, 14, 15 with respective metal products P supplied by the feed unit 119.

It is clear that modifications and/or additions of parts or steps may be made to the unit and method for drawing and straightening metal products as described heretofore, without departing from the field and scope of the present invention as defined by the claims.

In the following claims, the sole purpose of the references in brackets is to facilitate reading: they must not be considered as restrictive factors with regard to the field of protection claimed in the specific claims.

The invention claimed is:

1. An apparatus for working metal products comprising a drawing and straightening unit for feeding metal products, said unit comprising at least one first roller provided peripherally with a plurality of circular grooves configured to accommodate at least one of said metal products, and a number of second rollers opposite said first roller with respect to an axis of feed of said at least one metal product that is equal to the number of grooves of the first roller, so that each second roller is aligned with a respective groove, wherein there is an adjuster associated with said drawing and straightening unit and configured to move said unit in a direction of adjustment transverse with respect to said axis of feed so as to align, in use, one or more of said grooves with respective metal products fed by a feed unit disposed upstream.

2. The unit according to claim 1, wherein said direction of adjustment is orthogonal to said axis of feed.

3. The unit according to claim 1, wherein said direction of adjustment is parallel to the axis of rotation of said first roller and/or of said at least one second roller.

4. The unit according to claim 1, wherein the apparatus comprises an assembly comprising a mobile support on which said first roller and at least said one second roller are mounted, and in that said adjuster is able to move said assembly in said direction of adjustment.

5. The unit according to claim 1, wherein said adjuster comprises at least one of either a jack, a linear actuator, slide guides, chain mechanisms, rack or grub screw mechanisms.

6. The unit according to claim 1, wherein said first roller is motorized and is provided with three of said circular grooves, of which an internal groove, an external groove and a central groove made between them, and in that said second rollers are idle and comprise respectively a second external roller, a second internal roller and a second central roller disposed between them.

7. The apparatus according to claim 1, wherein said feed unit comprises at least one feeder body provided with guide apertures, said drawing and straightening unit being movable between at least one waiting position and a plurality of alignment positions in which one or more of said grooves are aligned with one or more of said guide apertures along the axis, or axes, of feed.

8. The apparatus according to claim 7, wherein said feeder body is disposed in such a way that at least the through axis of one of said guide apertures is coplanar and parallel at least to an initial segment of said axis of feed.

9. The apparatus according to claim 1, wherein said feeder body of said feed unit is mobile along an axis of alignment orthogonal to said axis of feed and to said direction of adjustment.

10. A drawing and straightening method for feeding one or more elongated metal products to a machine for working such metal products, comprising:

- a step of supplying one or more metal products to a drawing and straightening unit carried out by a feed unit which supports them slidingly,
- a step of drawing said one or more metal products by using said drawing and straightening unit in which at least one first roller accommodates, in respective grooves, said one or more metal products which are simultaneously contrasted in position by a number of second rollers with respect to an axis of feed equal to the number of grooves of the first roller, so that each second roller is aligned with a respective groove,
- wherein between said supply step and said drawing step there is provided an adjustment step in which said drawing and straightening unit is moved in a direction of adjustment transverse with respect to said axis of feed so as to align one or more of said grooves with respective metal products, and in that said drawing step is performed with the number of second rollers.

11. The method according to claim 10, wherein the step of drawing said one or more metal products by using said drawing and straightening unit comprises selectively drawing a pair of metal products each having a first diameter along respective consecutive grooves, or drawing a single metal product having a second diameter along another groove, wherein said second diameter is greater than said first diameter.

* * * * *